US006425578B1

(12) United States Patent
Wood et al.

(10) Patent No.: US 6,425,578 B1
(45) Date of Patent: Jul. 30, 2002

(54) IMAGE RECORDING APPARATUS AND METHOD

(75) Inventors: James Buckingham Wood, London; Colin Marshall, Herts; Stephen Edward Fox, Beds., all of (GB)

(73) Assignee: Fujifilm Electronic Imaging Limited, Herts (GB)

( * ) Notice: Subject to any disclaimer, the term of this patent is extended or adjusted under 35 U.S.C. 154(b) by 0 days.

(21) Appl. No.: 09/395,866

(22) Filed: Sep. 14, 1999

(51) Int. Cl.[7] ..... B65H 3/06

(52) U.S. Cl. ..... 271/37; 271/38; 271/110; 271/118; 271/120; 271/121; 271/124

(58) Field of Search ..... 271/37, 38, 110, 271/111, 117, 118, 120, 121, 124

(56) References Cited

U.S. PATENT DOCUMENTS 3,819,266 A * 6/1974 Price ..... 355/64
3,845,951 A * 11/1974 Hamaker ..... 271/53
4,126,305 A * 11/1978 Colglazier et al. ..... 271/120
4,416,531 A * 11/1983 Mayer ..... 271/96
5,601,282 A * 2/1997 Milo et al. ..... 271/35
5,732,307 A * 3/1998 Yoshizuka et al. ..... 271/110

* cited by examiner

*Primary Examiner*—Christopher P. Ellis
*Assistant Examiner*—Mark A. Deuble
(74) *Attorney, Agent, or Firm*—Sughrue Mion, PLLC

(57) ABSTRACT

Image recording apparatus for recording an image on a recording plate, the apparatus comprising a plate store (1) for storing a stack (12) of recording plates separated by interleaved sheets;

a drum image scanner (6) on which recording plates are located for recordal of an image; and a frictional feed apparatus (2) for withdrawing recording plates from the store (1) and feeding them singly to the drum image scanner (6).

8 Claims, 6 Drawing Sheets

80
120
103
105
104

80
120
102
103

IMAGE RECORDING APPARATUS AND METHOD

FIELD OF THE INVENTION

This invention relates to a method and apparatus for recording an image on a recording plate.

DESCRIPTION OF THE PRIOR ART

Lithographic printing plates for which this invention is particularly well suited typically comprise a rectangular aluminum substrate onto which is deposited a thin layer of photographic polymer. In addition a further thin protective coating of a polymer such as PVA is often added.

Recording of the image information onto such a plate is typically achieved in an image scanner using a scanned laser beam which hardens the photographic polymer in a selective manner. Following recordal of the image in the image scanner, the lithographic plate is later used within lithographic printing apparatus. A similar system for the recording of an image may also be used in connection with photographic plates and for the purposes of this invention both lithographic and photographic plates are described as a recording plate or plates.

In order to achieve high productivity it is desirable to use an image scanner in conjunction with automatic feeding apparatus to sequentially feed recording plates from a store and deliver them to the image scanner via a transport system. Typically the store contains a stack of such recording plates separated by interleaved sheets which protect the sensitive surface of the plates on which the image will be recorded. The delivery of individual plates to the transport system is achieved by removing the top plate from the stack using a feed system. The stack of plates has a typical mass of up to 60 kg, all plates within the cassette being of equal size. It is desirable that the apparatus can supply these plates to the image scanner without manual intervention. Manual intervention is undesirable as it slows the overall process considerably and further increases the risk of exposure of the image recording surfaces to radiation. For similar reasons it is therefore desirable that the interleaved sheets are automatically removed from the plate feeding path and are placed in a receptacle for later disposal. These interleaved sheets are often made from paper which is considerably different in mechanical properties when compared with the recording plates.

The established practice in existing image processing systems is to withdraw the recording plates sequentially from the stack using vacuum-activated suckers. The suckers are mounted upon a movable gantry and engage the topmost recording plate, then lifting it clear of the stack. The gantry then moves the recording plate to a receiving position for feeding into the image scanner. Separating means are often provided for the removal of an interleaved sheet when this is the topmost constituent in the stack. For example such means may include a roller which is moved to engage with the topmost sheet and withdraw it from the stack towards a bin. However, due to adhesion between the topmost recording plate and one or more plates or interleaved sheets beneath, a multiple feed operation can occur which is required to be remedied by separation of the plates and sheets. Known methods of performing this separation include the blowing of air between the interfaces of the plates and sheets, or simply holding the topmost plate in an elevated position above the stack such that the action of gravity eventually causes separation of the mis-fed items beneath.

Typical problems with such a system are that oxygen depletion under the suckers causes degradation of the emulsion, and secondary vacuum effects lead to multiple plate feeding.

One major problem with the use of vacuum suckers is that they engage in a localized manner with the fragile coated surface of the recording plate. As the vacuum is supplied, the plate deforms locally in the areas under the suckers producing characteristic circular marks on the processed plate. A second problem that occurs in such vacuum systems, is that the vacuum pressure required to lift a plate vertically is different from that to lift a sheet. If the pressure is not adjusted between the feeds then, since the paper is porous, the suckers will lift an interleaved sheet as well as the plate below. The vacuum system must therefore be capable of distinguishing between plates and sheets and, having set the correct vacuum level and lifted the topmost item, must confirm that the separation has been achieved before the selected plate or sheet is moved away from the stack. The time required to perform these steps is relatively large and in many cases rate limiting to the productivity of the complete system. This method is also unable to be optimized for a full range of plate sizes and thicknesses. In addition the apparatus is costly and often unreliable.

Downstream of the plate store and feeding apparatus conventional systems load the recording plate into the drum image scanner and in such equipment the plate may be supported on an internal or external surface of a drum for the recording of an image. Typically the loading of the plate into the image recording position is achieved using rollers or drive belts. As the exact positioning of the plate is particularly important, such systems include the use of guides and stops to ensure correct alignment with the image recording device. De-skewing of the plate is conventionally achieved when the plate is in the imaging position, by applying of a trail edge force via a sprung system which applies a variable force at different points depending on the skewing of the plate. However, this relies upon low frictional forces between the plate and the drum, particularly in the case of drums having a small radius of curvature.

It is also important to ensure that the surface of the plate conforms with that of the drum, i.e. each part of the plate surface is in contact with the surface of the drum. Prior art systems typically achieve this by either using mechanical means to apply a force to the plate causing it to bow and therefore conform with the drum, or by applying a vacuum to the drum surface causing the plate to be held in the conforming position. An example of the former method involves the loading of the plate into the apparatus such that the leading edge abuts some end stops. Subsequently, fingers are driven against the rear edge of the plate causing it to bow outwards and conform with the drum. As the apparatus may be used with different sizes of plates, the fingers in this case may be controlled with stepper motors or a sprung system to ensure the correct degree of movement based upon plate size information given to the apparatus controller by an operator.

In the second case where a vacuum system is used to conform the plate to the drum surface, it is conventional to provide a plurality of grooves within the surface of the drum. The grooves are connected to apertures and a vacuum is applied to the grooves using suitable means. The grooves are respectively attached to separate vacuum circuits which are either switched on or off using a plurality of electronically controlled valves in order to apply a vacuum to an area corresponding to the size of the recording plate.

SUMMARY OF THE INVENTION

In accordance with one aspect of the present invention we provide image recording apparatus for recording an image on a recording plate, the apparatus comprising;

a plate store for storing a stack of recording plates separated by interleaved sheets;

a drum image scanner on which recording plates are located for recordal of an image; and a frictional feed apparatus for withdrawing recording plates from the store and feeding them singly to the drum image scanner.

In accordance with the second aspect of the present invention we provide a method of feeding recording plates from a plate store containing a stack of plates with interleaved sheets, to a drum image scanner, the method comprising withdrawing plates from the store and feeding them singly to the drum image scanner all under frictional control.

It has been found that frictional feeding apparatus can be used to successfully withdraw plates from a stack of interleaved plates and sheets in order to feed it to a drum image scanner. It has also been found that this feeding operation can be achieved without significant damage to the sensitive image recording surface.

In accordance with the third aspect of the present is invention we provide frictional feed apparatus for feeding single recording plates or single interleaved sheets from a stack of recording plates and interleaved sheets, to an output position, the apparatus comprising;

a nudger member for nudging a plate or sheet in the stack towards a feed location; and a feed member and cooperating separation member at the feed location for feeding single plates or sheets to the output position;

wherein the contact surfaces of the nudger, feed and separation members are arranged so as to produce sufficient frictional force when in contact with either a plate or a sheet, such that plates or sheets are fed singly towards the output position.

The feed apparatus described is capable of withdrawing either recording plates or interleaved sheets in a similar manner and passing them to an output location. The apparatus may be used to withdraw plates or sheets from either the top or the bottom of a stack but preferably the topmost plates or sheets are withdrawn. The nudger member which preferably comprises a nudger roller engages the first plate or sheet in the stack and passes it to the feed location. Preferably the feed member is also a feed roller and the sheet or plate is passed into the nip of the feed member and the separating member. The nudger and feed members may be coupled by suitable means such as a belt, gears or a chain and sprocket. The separating member is preferably a retard pad which may present a surface inclined to the feed direction of the plate or sheet to ensure that the nip is maintained but to allow passage of the plates and sheets. The feed and separating members are preferably urged together using urging means. The separating member is preferably pivoted, with an angled pad underneath that is sprung to provide a nip force. Preferably the urging means comprises a spring attached to the retard pad. The spring therefore provides a force to oppose the movement of the separating member. It will be appreciated that the feed member may also be movable and provided with urging means.

In the event of a malfunction during a feed operation, it is desirable to include means to separate the feed and separating members. This is preferably achieved using a motor and eccentric cam.

It is desirable that only one member within the frictional feed apparatus drives the plate or sheet forward at any one time and therefore the apparatus preferably further comprises nudger member movement means to move the nudger member from the nudging position to a retracted position. This may be achieved using a rotatably mounted cam. In this case the nudger member may simply be returned to the nudging position under the action of gravity.

Preferably the apparatus further comprises stack position sensing means to detect when the nudger member is in the nudging position, in order to feed a plate or sheet from the stack. It will be appreciated that the position of the nudger member in contact with the stack need not be used to measure the position of the next item to be fed from the stack as the position of this item could be measured directly using appropriate sensing means, for example using an optical sensor.

Advantageously the use of the feeding apparatus according to the present invention greatly improves the speed with which plates can be drawn from the plate store, for example a feeding speed of 80 mm per second can be achieved.

The action of shearing a recording plate from the stack requires a smaller force than that required to lift the plate vertically and it will be appreciated that if a vacuum exists between the plate and interleaved sheets, it is easier to separate these by shearing rather than separating them in a direction normal to their contact surface. Typically, the force required to separate a plate by shearing is in the range 1N to 20N, whilst the force required to separate a plate by lifting ranges between 2N and 70N. The magnitude of these forces is affected by the size of the plates, the environmental conditions, the condition of the plate stack and storage conditions.

For example plates stored horizontally at the bottom of a stack of boxes prove very difficult to separate. The use of a smaller force is advantageous as it reduces the risk of damage to the surface of the recording plates.

It is also advantageous to use similar apparatus to remove both recording plates and interleaved sheets from the stack. Preferably these then require selection at a position downstream of the feed location. Typically the selection is achieved by placing a diverter in the path of the plate and sheets in order to divert only recording plates in a first direction towards the drum image scanner but to divert interleaved sheets in a second direction. Preferably this is achieved using sensing means, provided downstream of the feed location, in order to determine the presence of a plate or a sheet. Preferably the sensing means comprises an inductive sensor in order to detect the presence of a recording plate. Similarly an alternative or additional sensing means may be provided comprising a first radiation source to illuminate the upper or lower surface of the plate or sheet and a first sensor to detect any reflected radiation at a predetermined location. The material and surface properties of recording plates and interleaved sheets cause radiation to be reflected in differing ways which allows them to be distinguished. As a variety of mis-feed scenarios can be envisaged involving a combination of plates or sheets, preferably this sensing means further comprises a second radiation source and a second sensor positioned such that the sensing means monitors the reflected radiation from both the upper and lower surfaces of the plate or sheet. The sensing means may then distinguish for example between a singularly fed plate and a plate and sheet fed in combination with the plate topmost of the two.

Preferably the diverter is arranged to be responsive to the output of one or more of the sensing means in order to prevent an interleaved sheet from being mistakenly fed to the drum image scanner.

As the nudger and feed members contact the sensitive surface of the recording plate, it is preferable that they are kept free of debris and therefore the apparatus preferably further comprises vacuum cleaning means to clean the nudger member and/or the feed member. The vacuum cleaning means may also include the use of a brush to dislodge debris from the nudger or feed members. Although the vacuum cleaning means may be attached to the support member of the nudger or feed members, preferably the vacuum is applied through ducting provided within the support member.

In accordance with a fourth aspect of the present invention we provide a method of withdrawing recording plates or interleaved sheets from a stack of recording plates and interleaved sheets, the method comprising nudging a plate or sheet in the stack towards a feed location using a nudger member and feeding the plate or sheet to an output position using a feed member with a cooperating separating member at the feed location wherein the contact surfaces of the nudger, feed and separation members are arranged so as to produce sufficient frictional force when in contact with either a plate or a sheet, such that plates or sheets are fed singly towards an output position.

Typically the method further comprises moving the nudger member away from the nudging position when the first plate or sheet is in contact with the feed or separating members. Preferably the method further comprises the diverting of the interleaved sheets away from the output position.

Once the recording plate has been fed to the output position, it may then be engaged by an input module. An example of such an input module comprises a friction belt which transports the plate over one or more rotatably mounted rollers. Preferably, the belt and rollers are driven at substantially the same velocity. Advantageously the belt and rollers are arranged such that only the belt contacts the sensitive surfaces of the recording plates whereas the opposite surfaces are contacted with the rollers. Such a cooperating roller and belt system transports the plate into the drum of the image scanner.

Once within the drum, the plate is then engaged with plate alignment apparatus which, in accordance with a fifth aspect of the present invention, is provided for the alignment of a recording plate on a drum of a drum image scanner, the apparatus comprising; an elongate pusher bar extending along the drum and substantially parallel to the cylindrical axis of the drum, wherein the bar has a pusher surface having an elongate axis extending along the bar and substantially parallel with the cylindrical axis, and means for moving the bar in a circumferential manner following the surface of the drum, the elongate axis of the pushing surface remaining substantially parallel to the cylindrical axis, wherein in use, the pusher surface engages with the rearmost edge of a recording plate and urges it to a first position for the recordal of an image.

Typically the partial loading of the plate into the drum image scanner involves passing the plate over the elongate pusher bar of the plate alignment apparatus. The bar may be fitted with additional rollers which effectively extend the path of the input module along which the plate is fed. Once the rearmost edge of the plate has passed the pusher bar preferably the pusher bar drops and engages the rearmost edge of the plate. It is preferable that the pusher bar is urged against the surface of the drum to ensure that it correctly engages with the plate's rear edge.

The movement of the bar may be achieved using pinions mounted to the pusher bar and corresponding tracks mounted upon the drum, the bar being fixed to the drum using suitable bearings mounted on a rim provided at the drum edges.

It is envisaged that the alignment means according to the present invention may be used together with vacuum conforming means to conform the plate. Alternatively it may be used to apply the required bending force to the plate as part of a mechanical conforming means.

The circumferential motion of the pusher bar drives the plate from the rear towards a punching means which preferably comprises retractable end stop pins against which the plate is urged. The retractable end stops are positioned within the drum to abut the leading edge of the recording plate when the plate is located in the first position. Typically at least one sensor is positioned to detect the leading edge of the plate when it approaches the pins.

Preferably lateral correction means are also fitted to the punching means to correct the position of the plate in a direction substantially parallel to the cylindrical axes of the drum. Such means may comprise pins which are symmetrically opposed about the centre of the drum's cylindrical axis. The pins in this case therefore remain equidistant from the centre of the drum and are moved inwards in order to engage with the sides of the plate causing it to be positioned centrally.

Preferably the apparatus further comprises a slip clutch mounted to the moving means of the pusher bar. This allows the bar to be pushed against the rearmost edge of the plate after lateral position correction, to effect the final plate positioning in the apparatus, the force with which the plate is urged against the end stop pins being determined by the slip clutch.

Advantageously the punching means is arranged to remove at least one portion of the recording plate. This may be achieved preferably using at least one punch indenter which passes through the plate during punching and holds the plate in position during later imaging.

Having positioned the plate within the apparatus it is advantageous to conform the plate to the surface of the drum using vacuum means.

In accordance with a sixth aspect of the present invention we provide a drum of a drum image scanner for locating recording plates of differing dimensions on the surface of the drum, the surface of the drum on which the plates are located containing a plurality of circumferentially extending axially spaced grooves, wherein each groove contains at least one aperture, all the apertures being connected to a vacuum source whereby all the apertures receive substantially the same vacuum level at all times, the apertures being located such that, when at least part of the length of a groove is covered by a plate, the covered portion contains the aperture or apertures opening into that groove.

This arrangement is advantageous in that complex and expensive valve mechanisms are not required for the performance of the invention. Typically each groove is closed at one end such that it does not extend to the edge of the drum, and contains only a single aperture. Advantageously this arrangement of grooves and apertures in connection with a vacuum source provides the capability of conforming various sizes of recording plates to the surface of the drum without the need for complicated vacuum circuits.

BRIEF DESCRIPTION OF THE DRAWINGS

Examples of the image recording apparatus and method according to the present invention will now be described in accordance with the accompanying figures in which.

DETAILED DESCRIPTION OF THE EMBODIMENTS

Figure 1:
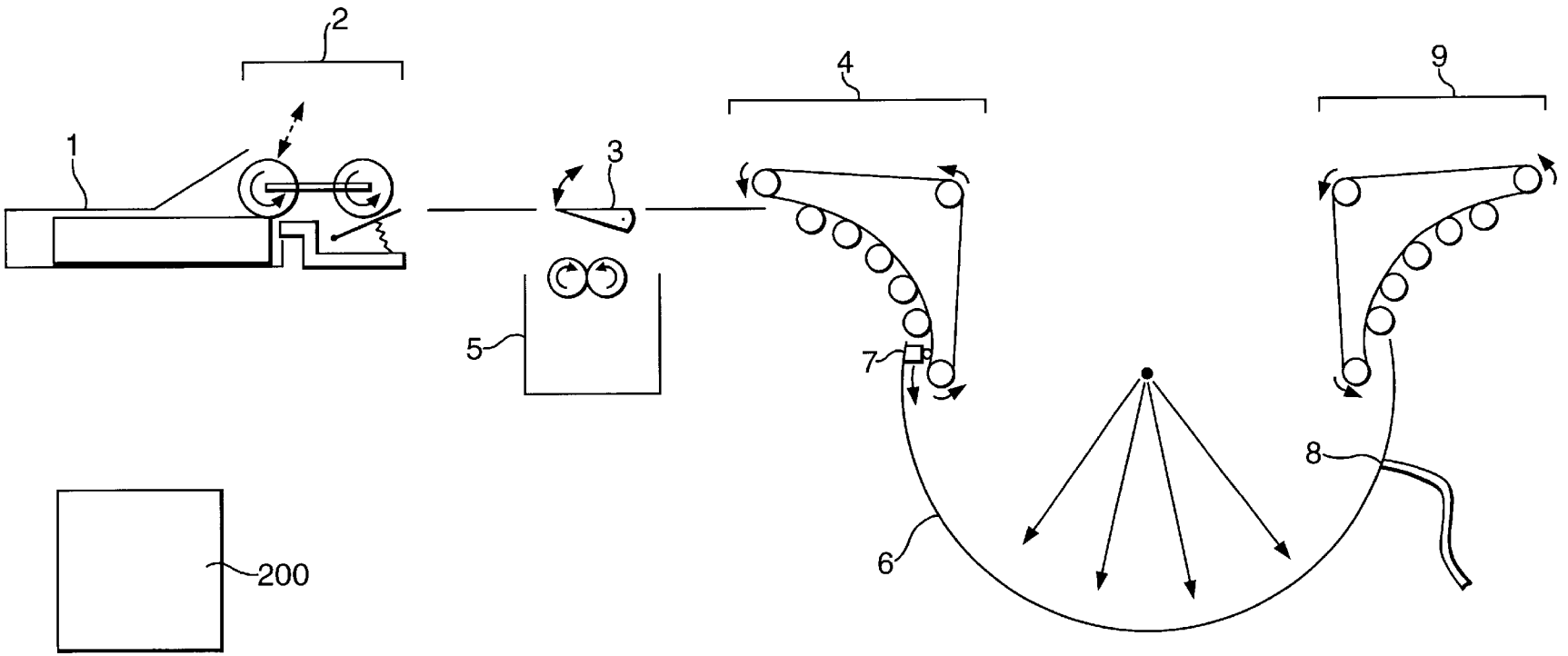
FIG. 1 is a simplified side view of the image recording apparatus.

An example of the apparatus according to the present invention is shown in FIG. 1.

The apparatus comprises a plate store 1 which contains a stack of radiation-sensitive lithographic recording plates. A variety of plate sizes may be used, typical dimensions lying within the range 400–960 mm length (front to rear edge) and 500–1160 mm in width. These plates are separated by interleaved sheets of paper. The topmost item (either a plate or sheet) in the stack is fed from the stack by frictional feed apparatus indicated generally at 2. The item is first sheared from the items below by a nudger member and is then passed to a feed member.

As the topmost item may not always be sheared from the item beneath, for example a sheet may stick to the underside of a plate, the feed member cooperates with a separating member to separate the topmost item from any additional items adhered to it. The initial shearing of the item from the stack and the separation of any adhered items is achieved using frictional forces applied to the surfaces of the items.

When the topmost item has been successfully separated it is identified using sensing means and passed to a diverter 3. The diverter directs single recording plates in a first direction towards a plurality of axially spaced input modules generally indicated at 4. Interleaved sheets or any combination of recording plates and interleaved sheets identified by the sensing means as being mis-fed are diverted by a diverter 3 in a second direction towards a receptacle 5.

Each input module comprises a transport path formed between a band held against a train of rollers, receives a recording plate and passes it along an arced path onto the inner drum surface of a drum image scanner 6.

The rear edge of the recording plate is then engaged by a pusher bar 7. The pusher bar transports the plate over the internal surface of the drum to a recording position where it is conformed with the internal surface of the drum using vacuum means 8.

Following the recordal of an image on the recording plate surface, the pusher bar 7 is used to move the plate towards an exit position where it is removed from the drum using an output module, generally indicated at 9.

In order to automate the process, an electronic system controller 200 shown in FIG. 1, is provided to operate the apparatus using information inputted by a human operator and additional signals provided by sensing means positioned within the apparatus.

Each aspect of the apparatus will now be described in more detail.

Figure 2:
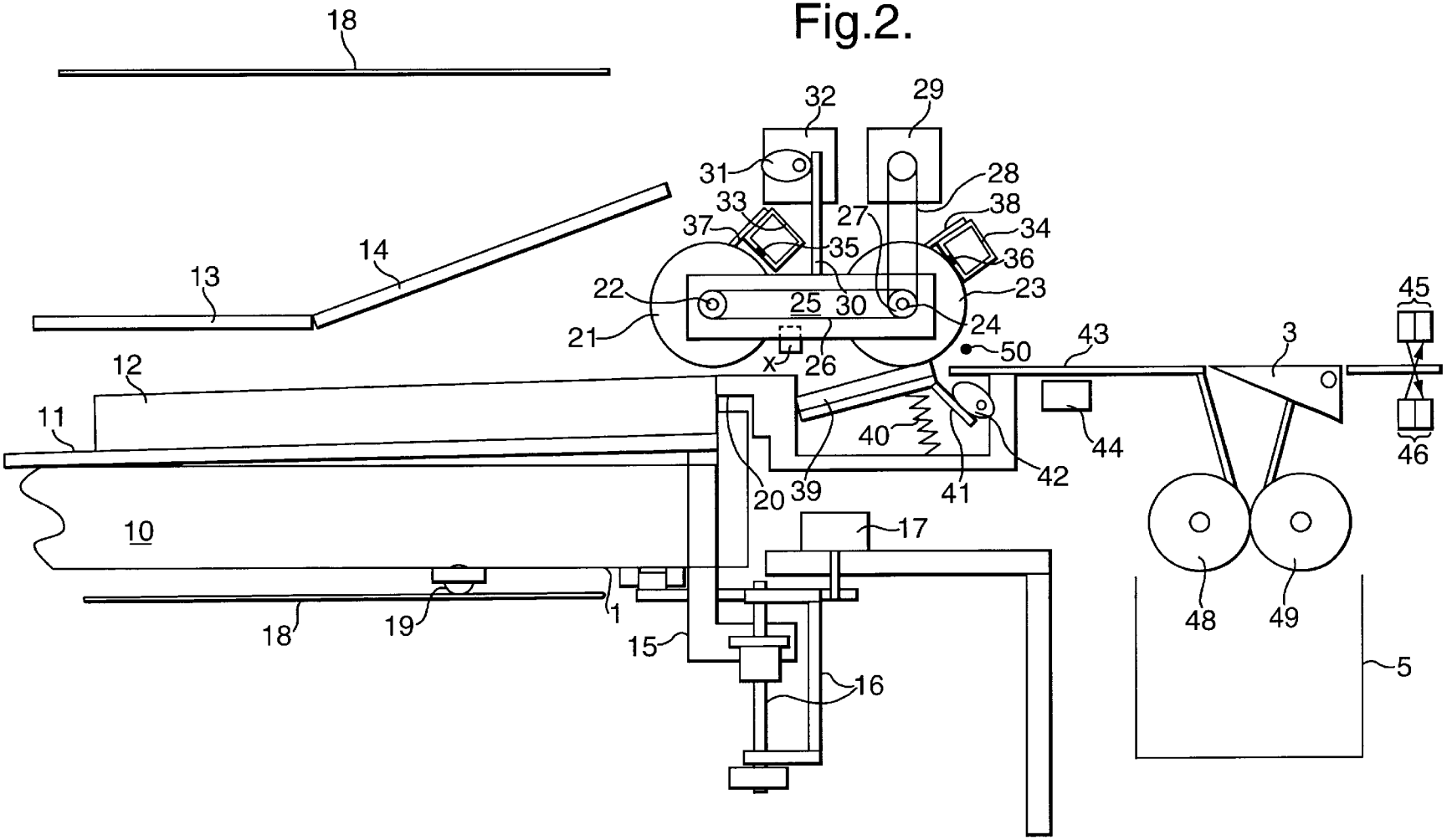
FIG. 2 is a side view of the plate feeding apparatus.

The frictional feed apparatus is shown in more detail in FIG. 2.

The plate store 1 comprises a light sealed cassette 10 containing a platen 11 upon which a stack 12 of recording plates is placed. Conventionally as in this example, the plates are separated by interleaved sheets of paper. The cassette has a lid 13 ensuring that the cassette is light-sealed when not in use. The front end of the cassette is defined as the end which is inserted into the feed apparatus and from which the plates are withdrawn.

The front part of the lid 13 comprises a hinged section 14 allowing the front section 14 to be raised with respect to the rest of the lid 13. Means are provided within the apparatus to open the lid as the cassette is inserted. A stack increment member 15 forming part of the feeding apparatus is arranged to contact platen 11 on its underside near to the front end of the cassette, the increment member 15 passing through the base of the cassette. The increment member allows the front end of the platen 11 to be lifted from beneath which in turn lifts the front end of the stack. The lifting of the stack raises part of the stack above the front wall of the cassette. An alternative arrangement can also be envisaged in which the whole stack is raised whilst remaining substantially horizontal. The stack increment 15 is engaged by a increment mechanism 16 which in turn is driven by an increment motor 17 in response to the system controller 200.

Upper and lower elevator shelves 18 are provided as part of the apparatus housing and the cassette is loaded between these in a slidable manner. The sliding of the cassette into the apparatus is aided by roller ball units 19 attached to the base of the cassette.

A lead edge guide 20 is provided as part of the feed apparatus, the guide 20 being positioned so as to act as a wall and allow only the topmost items to be removed from the stack by the feed apparatus. In the present example, the underside of the topmost item in the stack is typically only 0.3 mm above the top surface of the lead edge guide 20. A nudger roller 21 mounted upon an axle 22 is positioned above the topmost item at the front end of the stack. The nudger roller is mounted such that it can be lowered to contact the upper surface of the topmost item. Similarly a feed roller 23, of similar dimensions to the nudger roller 21, is mounted on an axle 24 in a position substantially parallel with the axis of the roller 21 but in a position downstream of the nudger roller, both axles being mounted in a support 25. The rollers 21 and 23 are coupled by a drive belt 26 entrained about a drive pulley wheel attached to each axle. An additional drive pulley wheel 27 is attached to the feed roller axle 24. The pulley wheel 27 is provided with a one-way clutch which allows driving of the feed roller only in the feed direction (anticlockwise in FIG. 2).

About this pulley wheel 27 is entrained a second drive belt 28 which provides drive to the feed roller from a drive motor 29. The pulley wheels are arranged such that when the motor 29 is driven in a feed direction, drive is transmitted to both the nudger and feed rollers to drive an item towards the drum image scanner. On the other hand if the drive direction of the motor is reversed, the one-way clutch ensures that no power is provided to the feed roller but that the nudger roller is driven in the opposite direction and allows plates or sheets to be passed back into the cassette. This is particularly advantageous in the event of a mis-feed malfunction. It will be appreciated that chains and sprockets could be used as an alternative method of driving the rollers.

A lifting member 30 is attached to the support 25, the support being pivoted about the position of the feed roller axle 24. A lift cam 31 driven by a lifting motor 32 is arranged to engage with the lifting member to raise the free end of the support by pivoting it about the axle 24. The nudger roller can therefore be moved between a first position where it is in contact with the topmost item, to a lifted position where no contact occurs. In order to increase the frictional force and feed efficiency, an additional mass (not shown) may be added to the support 25. Stack position sensing means X (shown in FIG. 2) are also provided, attached to the housing of the frictional feed apparatus. When the top of the stack is in the correct position for the feeding of the topmost item, the nudger roller contacting the stack will be located at a certain position with respect to the feed roller about which it is pivoted. The stack position sensing means X detects when the support 25 is angled at the correct position with respect to the pivot, and a signal is sent to the system controller 200.

The frictional feeding apparatus also contains vacuum cleaning means comprising tubes 33,34 running along the length of the nudger and feed rollers respectively. Elongate apertures 35 and 36 are provided in the tubes along a direction substantially parallel with the axis of the rollers, and at a position adjacent the roller surfaces. The tubes are connected to vacuum supply means which draws air over the surface of the rollers through the slots 35 and 36 and along the tubes 33 and 34 towards the vacuum source. Brushes 37 and 38 are additionally provided, running along the lengths of the nudger and feed rollers to dislodge any debris which will be removed by the vacuum means.

A retard pad 39 is positioned beneath the feed roller 23. In this example the retard pad is 10 mm longer than the feed roller to prevent creasing of the recording plates. The retard pad is urged into contact with the feed roller using two axially spaced springs 40. The pad is pivoted about an axis parallel with that of the feed roller, the axis being positioned at the upstream end of the pad. The retard pad is arranged such that it is angled in an upward direction towards the feed roller and is forced against the feed roller with the spring 40. The pad is arranged so that the nip between the pad and the roller is not positioned at the downstream end of the pad but rather away from the end by a small distance to increase its effectiveness. The pad therefore presents an upwardly inclined surface to an item being fed. The pad is also positioned such that the leading edge of an item being fed towards the nip contacts the surface of the pad a small distance upstream of the nip, and is deflected slightly upwards before entering the nip. This aids the separation of any multiply fed items as they are encouraged to be sheared prior to entering the nip.

A retraction member 41 is attached in a position near to the upper end of the pad beneath the feed roller. In the event of the apparatus jamming the pad can be retracted by the rotation of a driven cam 42 which engages with the retraction member 41. This pivots the pad away from the feed roller.

A nip sensor 50 is positioned downstream of the feed roller and adjacent the nip. The sensor is formed from a simple light source and diode which detects the presence of a plate or sheet by the action of obscuring the light from the source. The signal from the sensor 50 is monitored by the system controller 200. Sensing means 45 and 46 could alternatively be used to detect the presence of an item in the nip if they were correctly located adjacent the nip.

A plate guide 43 is provided downstream of the feed apparatus to support plates and interleaved sheets being fed from the feed roller. A diverter 3 is provided downstream of the plate guide 43, the diverter being deflected by a solenoid between a first position and a second position. Alternatively a motor driven system could be used.

At a position between the nip and the diverter 3, an inductive sensor 44 is located to detect the presence of a metallic recording plate. This information is used by the system controller 200 to identify the item and to position the diverter 3 in a first position in the case of a plate being detected, and a default second position in the case that a plate is not detected. Plates identified using inductive sensing are fed in the first direction along a second guide 47 towards further sensing means 45,46 and the image scanner; whereas interleaved sheets are fed in a second direction into the nip of driven rollers 48 and 49. These rollers are constructed from a resilient material. They are arranged so as to provide a strong nip force capable of removing any item from the system which is placed in the nip between them. These rollers are then driven to forcibly remove the sheets from the feed path for disposal into the container 5.

Further downstream of the diverter, sensing means 45 and 46 are positioned above and below the path of the fed items respectively. Each sensing means comprises a radiation emitter and a reflected radiation receiver although alternative means capable of distinguishing between plates and sheets could be used. In this example a light source is used in each case in conjunction with a corresponding photodiode to detect the intensity of the light reflected from the upper and lower sides of the fed item.

One critical parameter is the difference between the coefficients of friction of the feed roller and the retard pad. It is suggested that this is greater than the coefficient of friction between either surface of a recording plate and an interleaf sheet. The results of measurements of the coefficient of friction, $\mu$, between relevant surfaces are shown in Table 1 below.

TABLE 1

| Materials | $\mu$ (Typical) |
|---|---|
| Rollers: | |
| Polyisoprene on Emulsion | 2.3 |
| Retard Pad: | |
| Microcellular Urethane 150 on Plate | 1.2 |
| Between fed items: | |
| Aluminium side of plate on Interleaf | 0.5 |
| Emulsion side of plate on Interleaf | 0.3 |

It has been found that polyurethane materials are suitable for the construction of the feed and nudger rollers, isoprenes being used in this particular example. Similar materials may be used as the contact surface for the retard pad and for the rollers 48 and 49.

In this example the friction feed apparatus is centrally located with respect to a point halfway along the cylindrical axis of the drum image scanner. The rollers and retard pad are considerably narrower in width than the drum although a system in which they were the same width could be used.

The operation of feeding individual plates or sheets from the stack will now be described. A stack of recording plates separated by interleaved sheets is provided within the light seal cassette 10. The cassette is slidably inserted within the apparatus assisted by the roller ball units 19 running along the lower elevator shelf 18. As the cassette is inserted towards its loaded position, guides are used to raise the hinged portion 14 of the lid. When the cassette is correctly loaded, the lift motor 32 is operated causing the cam 31 to rotate and the nudger roller is lowered onto the topmost plate or sheet by the action of the gravity. The front end of the platen is then lifted by the action of the plate stack increment mechanism 16 being driven by the increment motor 17. The lifting of the platen at the front end raises the topmost plates and sheets clear of the front lip of the cassette. When the topmost items clear the top of the lead edge guide above, the position of the nudger roller causes the stack position sensing means X to send a signal to the system controller 200 and the increment motor is halted. When the cassette is correctly loaded, the lead edge guide 20 acts as a surface against which all but the very topmost plates in the stack abut. This guide therefore prevents a large number of plates and sheets being fed towards the feed roller. The drive motor 29 is then activated which rotates both the feed and nudger rollers. The friction force, normal force and roller torque between the nudger roller and the topmost item in the stack causes the item to be sheared from the rest of the stack and driven towards the nip of the feed roller and retard pad. During correct operation when a single plate or sheet passes between the feed roller 23 and the retard pad 39, the action of the feed roller 23 is sufficient to drive the plate or sheet onto the plate guide 43 against the resistance of the retard pad. However, it is undesirable to drive the plate or sheet with both the nudger and feed rollers as minor speed differentials result in scrubbing or buckling and therefore the nip sensor 50 is used to detect the presence of a plate or sheet within the nip. A signal from the sensor 50 is sent to the system controller 200 and this then operates the motor 32 to rotate the cam 31. The rotation of the cam has the effect of lifting the nudger roller from the surface of the plate or sheet but because the support 25 is pivoted about the axle 24, the feed roller 23 remains in contact with the fed item.

Although the presence of the lead edge guide 20 should prevent a large scale mis-feed, it is possible for a small number of plates and sheets to be fed in a group towards the nip of the feed roller and retard pad. Usually, the angle and position of the retard pad 39 with respect to the feed roller 23 provides a sufficient shearing force to separate the topmost item from any others attached to it beneath, particularly as the leading edge contacts with the retard pad first before entering the nip. However, in the case of a multiple feed the spring 40 allows the retard pad to deflect and the multiple items are drawn into the nip.

As the position of contact between the feed roller and the retard pad occurs at a distance away from the end of the retard pad, and because the retard pad is angled in an upward direction, any multiply fed items experience a greater shearing force as they pass further into the nip. This enhances the possibility that they may be separated.

In the unlikely event of a large number of adhered plates and sheets are passed into the nip causing a jam of the system, the motor 29 can be stopped. The retard pad can be lowered by the action of the cam 42 engaging with the retraction member 41 and the items can be returned to the cassette by the later reversal of the motor 29. Due to the action of one-way clutch attached to the feed roller, only the nudger roller is driven in the reverse direction which allows the mis-fed items to be removed. As the cassette is light sealed, the items can be replaced within the cassette and the cassette replaced. Conveniently the replacing of the items within the cassette prevents exposure of the recording plates to light.

It is important that only recording plates are fed to the drum image scanner and that there is no possibility of feeding anything but single recording plates. During normal operation, the presence of a plate is detected by the inductive sensor 44 and the diverter 3 is positioned to pass the plate towards the image scanner. At all other times when a plate is not present the diverter is positioned to direct any items towards the container 5 via the driven rollers 48,49. However, to deal with the slight possibility that a plate and sheet may pass through the nip, the plate being detected by the sensor 44 and passed towards the image scanner onto the plate guide 47, the sensing means 45 and 46 are positioned downstream of the diverter 3. The fed item is identified due to the differences in reflectivity between interleaved sheets and either surface of a recording plate. If the controller 200 identifies signals from both sensing means 45 and 46 that correspond to a recording plate then the system controller 200 allows the plate to continue downstream and to be loaded into the drum image scanner. If this is not the case, for example if signals are detected corresponding to a plate on one side and a sheet on another, then the controller 200 halts the system allowing the mis-feed operation to be corrected.

Figure 3:
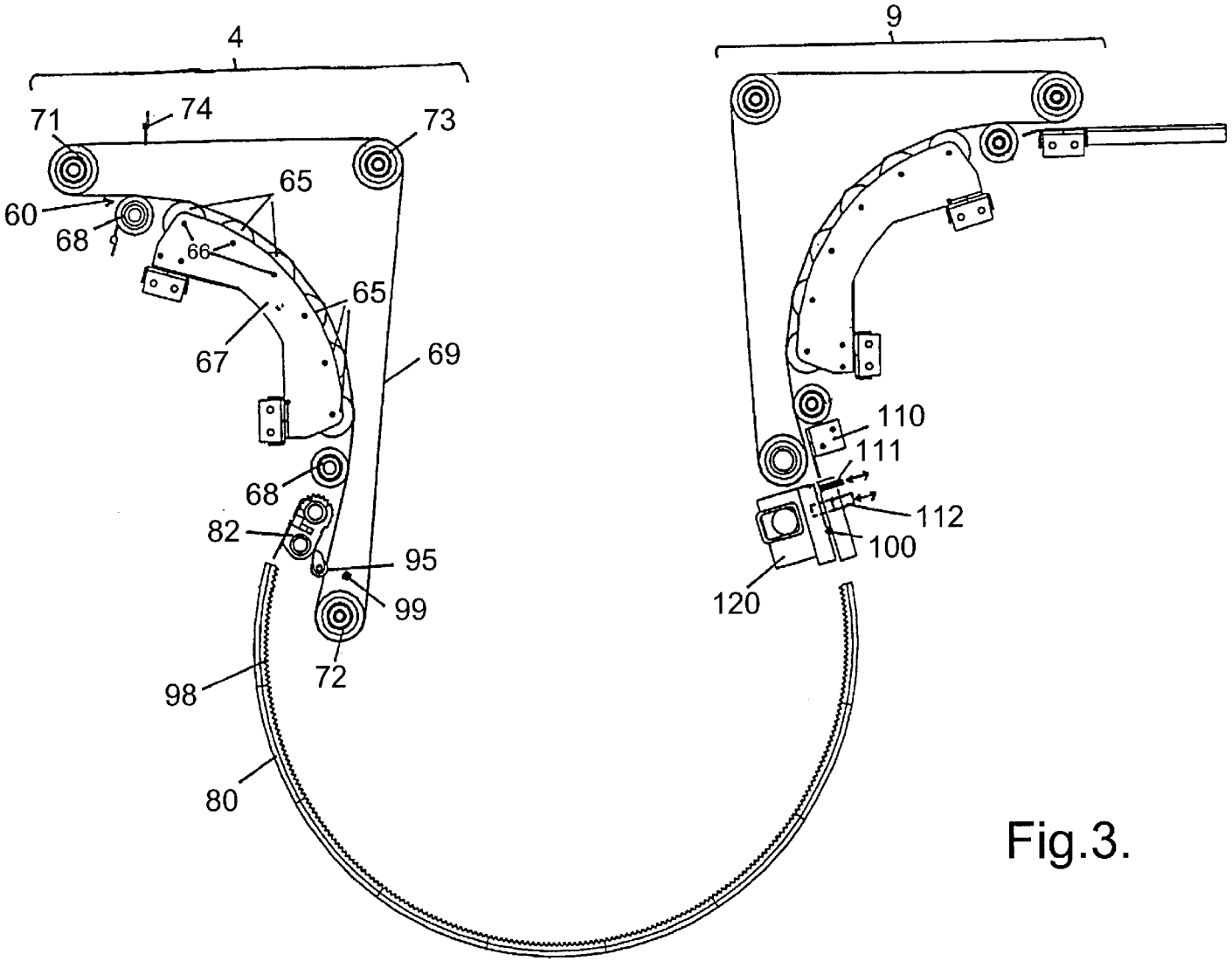
FIG. 3 is a side view of the input module.

A successfully identified and separated recording plate being fed along the second plate guide 47 is then engaged by the input module apparatus in order to load the plate into the drum image scanner. The position of the input module 4 with respect to the drum of the image scanner is shown in FIG. 3.

The input module apparatus 4 comprises a plurality of idler rollers 65 which are rotatably mounted upon axles 66 held within a support 67. The idle rollers 65 are arranged in an arc to divert the plate from the feed direction in a curved path into the drum 80 of the drum image scanner 6. In the present example, the radius of curvature of the arc is not less than 200 mm at any point and the path of the plate is diverted through 115 degrees into the drum.

Driven soft rubberized rollers 68 are provided at positions both upstream and downstream of the curved path of the idler rollers and provide a smooth extension to the curved train of idler rollers 65. In order to hold the recording plate in contact with the driven and idler rollers, a driven band 69 is provided which is entrained about three crown rollers 71,72,73. Crown roller 71 is positioned upstream of the upstream driven roller 68 but is positioned on the opposite side of the recording plate feed path. Similarly crown roller 72 is provided in a position downstream of the downstream driven roller 68 and again is positioned on the opposite side of the recording plate path. The band 69 supports the upper surface of the plate as it is transported through the feed path, the underside being supported by the train of rollers. The pressure applied by the band to the emulsion surface of the plate never exceeds $1N/mm^2$.

The third crown roller 73 is positioned so as to ensure that the parts of the band 69 not forming part of the curved path, are kept clear of the driven and idler rollers and provide a pre-determined tension. One-way clutches are used on all of the driven rollers to aid the clearance of any plates jammed in the apparatus. The rollers are also provided with knobs so that they can be rotated manually.

Cleaning strips 74 are also provided to remove debris from the band and are conveniently located at a position contacting the band 69 where the band is not in use as part of the curved feed path. The drive rollers 68 and crown rollers 71 to 73 are driven by a single motor to ensure that both sides of the feed path are driven at a similar velocity. Rubber materials are suitable for use as the contact surfaces of the rollers. The apparatus is capable of transporting the plates at speeds of up to 250 mm per second if required.

Figure 4:
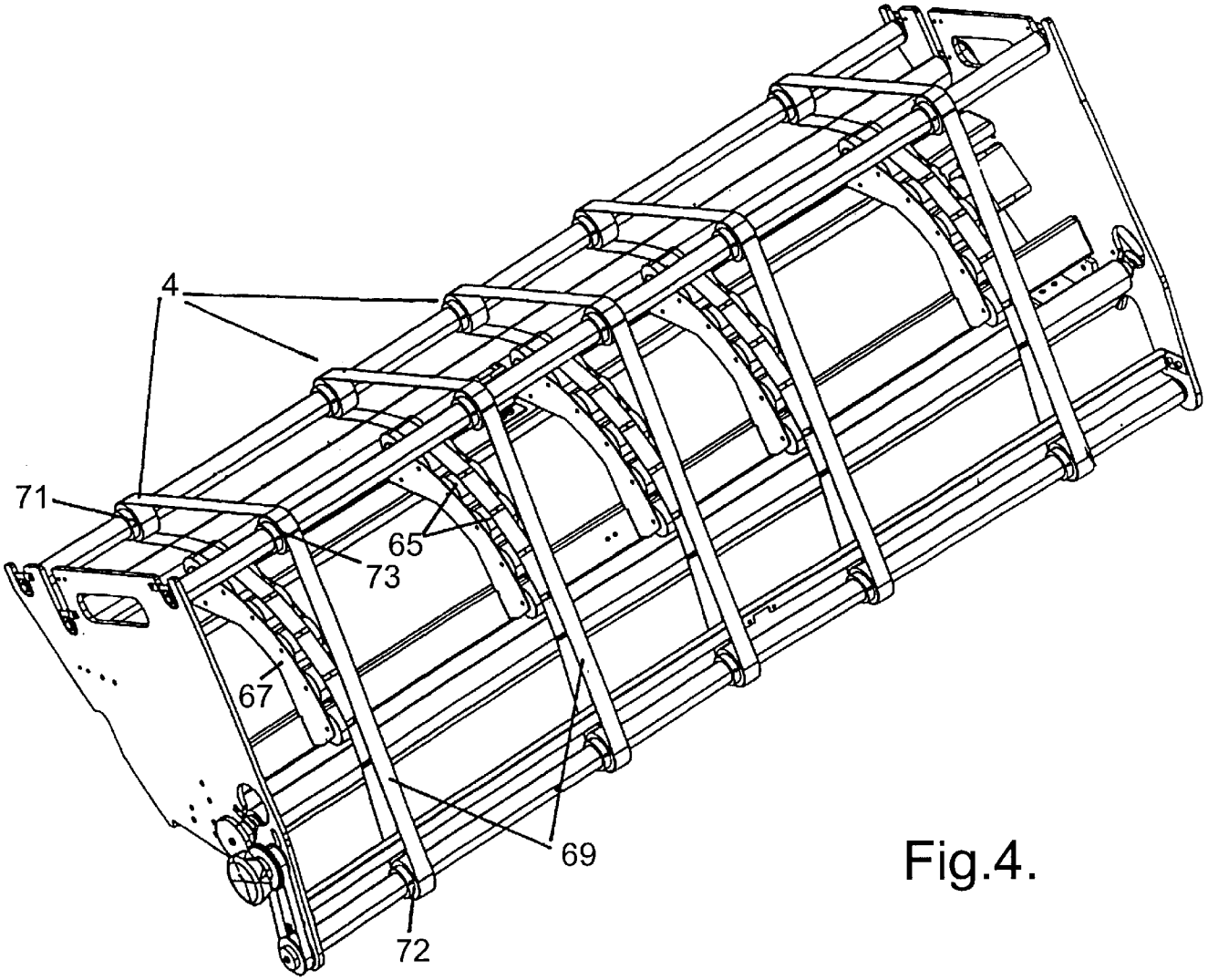
FIG. 4 is a perspective view of the input modules.

Due to the dimensions of the recording plate, a plurality of input modules of the form described are provided in parallel along the direction of the cylindrical axis of the drum image scanner. This is more clearly shown in FIG. 4 in which a plurality of input modules 4 are shown. It will be noted that the input modules 4 are not equally spaced along the cylindrical axis of the scanner but are symmetrically arranged about the point half way along the drum. The positioning of the input modules is determined by the various widths of recording plates used in the industry.

The alignment of the centre of the feeding apparatus with the centre of the drum image scanner conveniently allows plates of various widths to be used.

Returning to FIG. 3, during operation, the leading edge of a recording plate is passed into the input module at a position 60. The leading edge of the plate is then engaged in the nip between the upstream driven roller 68 and the band 69. The plate is then fed by the driving action of the rollers and band along the curved path of the roller train, the band ensuring that the plate is held against these rollers as it is transported through the arc. The front edge of the plate is then engaged by the downstream driven roller 68 and is driven into the drum 80 of the drum image scanner. As the plate enters the drum it passes over an idler roller 95 attached to the plate alignment apparatus 82, which will now be described.

Figure 5:
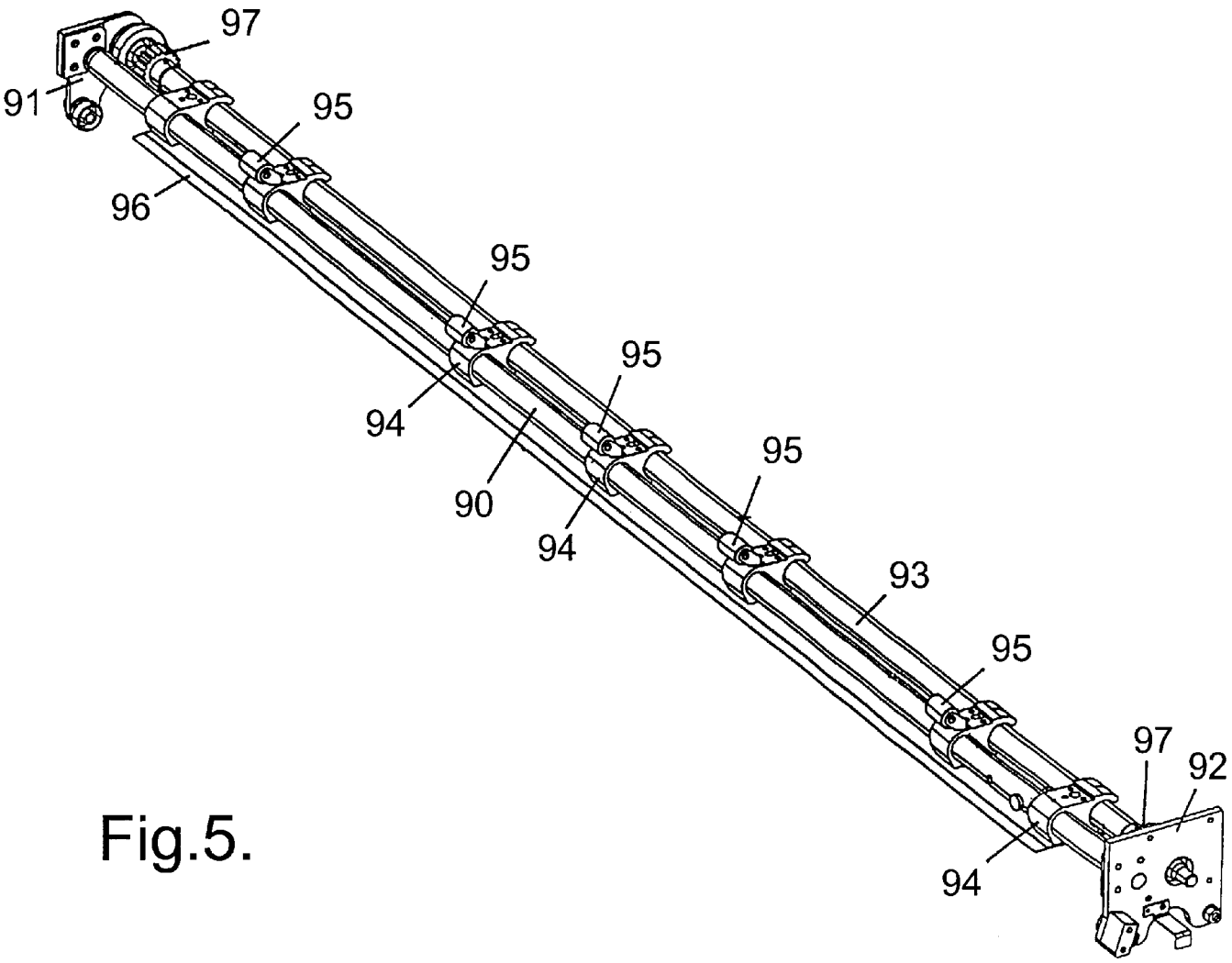
FIG. 5 is a perspective view of the plate alignment apparatus.

The alignment means 82 is shown in FIG. 5. The alignment means comprises a support shaft 90 at one end of which is positioned a first end support 91, and at the other end a second end support 92. Parallel to the support shaft and in an adjacent position is mounted a drive shaft 93 which is rotatably mounted on an axle into the end supports 91 and 92. The drive shaft 93 is supported at a plurality of positions along its length by shaft supports 94. Upon some of the shaft supports 94 are mounted sprung idler rollers 95 and each of the supports containing the idler rollers are positioned such that they align along the cylindrical axis of the drum with the positions of the input modules 4. When the alignment means 82 is in its start position during the loading of the recording plate into the drum, the idler rollers 95 engage with the band 69 and form a continuation of the curved path (see FIG. 3). This assists with the loading of the recording plate into the drum 80.

Referring to FIG. 5, on the opposite side of the parallel shafts from the idler rollers 95, an elongate pusher bar 96 is located. This bar is attached to the supports 94. Pinions 97 are non-rotatably mounted onto the drive shaft 93 at a position adjacent the end supports 91, 92. These pinions 97 run in corresponding tracks 98 attached to each end of the drum 80. The tracks 98 are arranged to conform with the internal surface of the drum 80, such that the movement of the alignment means along the tracks 98 causes the pusher bar 96 to pass across the internal surface of the drum. As the internal surface of the drum is formed in a cylindrical manner, the orientation of the bar with respect to the drum surface is maintained by bearings positioned at each end of the alignment means 82. In order to attach the alignment means to the surface of the drum, a lip is provided around the circumference of the drum 80 at each edge. Eccentric bearings and pitch rings are used to ensure that the alignment means remains in the correct orientation and geared within the tracks at all times.

The pusher bar 96 is constructed from polycarbonate and is biased against the surface of the drum, causing constant contact with the drum at all points along the bar. This biasing ensures that the edge of the plate does not pass between the bar and the drum surface. The movement of the alignment means is powered by a motor (not shown) coupled to the drive shaft 93. A slip clutch is provided as a coupling between the motor and the drive shaft which prevents movement of the alignment means if it encounters sufficient resistance.

Sensing means 99 are provided in a position adjacent the idler rollers 95 to detect the passage of the trailing edge of the recording plate.

Once the trailing edge has passed the sensing means 99, the controller 200 operates the alignment means 82. The drive shaft 93 is rotated and this causes the alignment means 82 to move in a direction following the surface of the drum whilst the long axis of the alignment means remains parallel with the central cylindrical axis of the drum 80. The orientation of the pusher bar 96 with respect to the drum surface is constantly maintained during the movement of the alignment means.

The motion of the alignment means 82 causes the rear edge of the recording plate to be engaged by the pusher bar 96. The bar transports the plate towards an imaging position and due to the parallel nature of the bar with the cylindrical axis, the driving of the plate only by contact with the rear edge ensures that the rear edge of the plate is parallel with the cylindrical axis and is therefore deskewed by the time it arrives at the imaging position.

The plate is driven around the surface of the drum until the front edge enters a punching means 120. The punching means contains four retractable pins 111 which act as front stops for the plate and against which the plate abuts when correctly located for imaging. For wide plates the leading edge abuts all four pins, smaller plates only contacting with the two centremost pins. As shown in FIG. 3, a sensor 100 detects the arrival of the front edge of the recording plate in the punching means.

One or more punching indenters 112 are provided within the punching means to remove through thickness sections of the recording plate for the purpose of accurate alignment of the plate within the printing apparatus downstream of the scanner. The apparatus may be provided with the ability to punch a variety of different shapes out of the plate in accordance with the various printing presses used in the industry. The punching means in the present example has the capability of punching up to 13 slots or holes along the edge of a plate, along with two different punch options for different types of printing press.

Centring means are also provided as part. of the punching means, the centring means comprising two movable pins. The pins are mounted using rack and pinion apparatus and are arranged to move in correspondence with each other such that at all times, each pin is equidistant from a point halfway along the cylindrical axis of the scanner. The pins are arranged to move only in a direction parallel with the cylindrical axis and this is achieved using a rack for each pin and a single pinion. The use of the pusher bar advantageously ensures that the plate is not substantially skewed by the action of the centring means.

The retractable pins 111, punch indenters 112 and the centring means are controlled by the system controller 200.

When the front edge of the recording plate is detected by the sensor 100, the movement of the alignment means is halted. However, due to the time delay required to achieve this, the sensor 100 is not positioned such that the front edge of the plate abuts the end stops within the punch. Once the movement of the recording plate has halted, the centring pins are brought in from either side of the plate by the controller 200 to centre it laterally within the drum. The pusher bar is then driven forwards again and the plate is pushed against the retractable pins 111 within the punch. This causes sufficient resistance against the bar for the slip clutch to slip which is detected by the controller 200 using a sensor. The controller 200 accordingly stops the motion of the bar and the front end of the recording plate is then punched by the punching indenters 112. This method can be used to reproducibly register the plates within a 200 micrometre repeatability skew range. Unlike conventional punching means, the punch has a bridged form which allows the passage of the whole plate through the punch rather than requiring the plate to be withdrawn in a reverse direction following punching.

Once the indenters have passed through the plate they are held in position to further secure the plate whilst the controller 200 then applies the vacuum means to conform the plate fully to the surface of the drum for imaging.

Figures 6A, 6B:
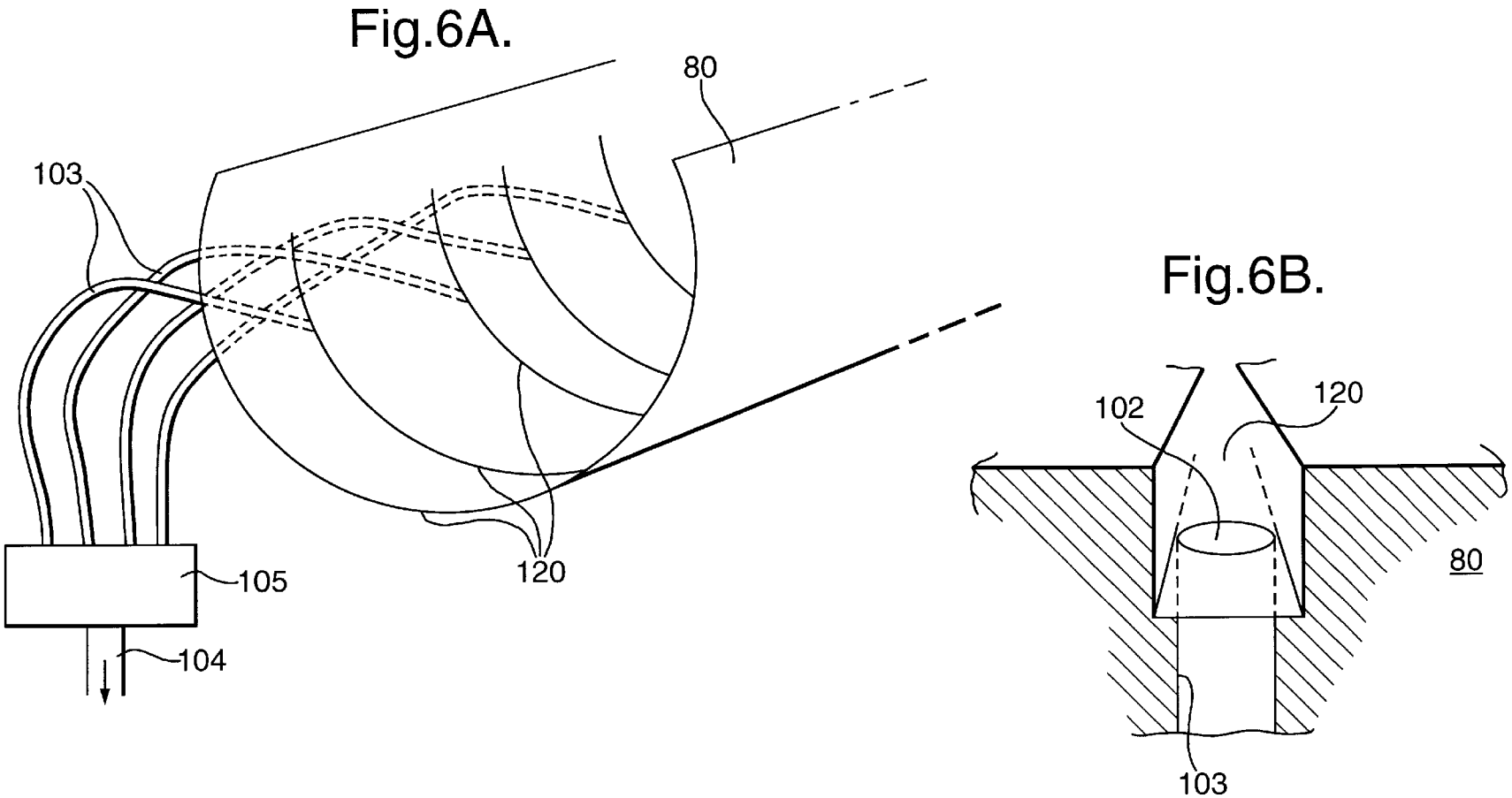
FIG. 6A is a perspective view of the drum containing grooves.
FIG. 6B illustrates the view along one groove.

As shown in FIG. 6A the vacuum means comprises a series of parallel grooves 120 positioned within the internal surface of the drum. A plurality of grooves (22 in the present example) are provided and these are not equally spaced axially along the drum but rather are positioned according to the various sizes of plate which will be used within the scanner. Each groove does not fully extend around the drum, the downstream end of each groove being closed at a position corresponding to the location of the front edge of the plate during imaging. At 350 mm from the closed end of each groove, a circular aperture 102 is provided in the groove base, this distance being smaller than the 400 mm length of the smallest plate type used in the apparatus.

In each case the rest of the groove continues around the internal surface, at a constant distance along the cylindrical axis, and terminates at the edge of the drum at the upstream side. Vacuum supply tubes 103 are connected to each aperture as shown in FIG. 6A and these are collectively connected to a main vacuum tube 104 via a manifold 105. This ensures that each aperture experiences a similar vacuum level at all times. In this case the grooves are of square cross-section with the side of the square being 1 mm in length and the aperture is circular with a 1 mm diameter (see FIG. 6B).

When the recording plate is correctly positioned within the apparatus and the punching indenter is engaged, the controller 200 applies the vacuum to the grooves in order to conform the plate to the surface of the drum. The positioning of the aperture within each groove ensures that if a groove is partially covered by a plate, then the respective aperture is also covered whereas those grooves which are not covered do not sufficiently reduce the efficiency of the vacuum source.

Using this method of conforming the plates, the underside of the recording plates can be brought within 50 micrometres of the drum surface at all points.

When the recording plate is held in position by the vacuum, the controller 200 initiates an imaging step after which the vacuum is released, the indenter pins 112 are removed and the front stop pins 111 are retracted.

The alignment means is then used to push the recording plate from the imaging position further towards an output position. At the output position a guide 110 guides the front edge of the recording plate into the nip formed by a band and driven roller of the output modules. The output modules 9 are of similar form to the input modules although of slightly different geometry. Again the output modules comprise bands and rollers in order to pass the recording plate though a curve and on towards apparatus downstream of the drum image scanner. The pusher bar is then returned to its first position in order to receive the next plate for imaging, the time taken between unloading of an exposed plate and the loading of the next one being less than 30 seconds.

We claim:

1. Frictional feed apparatus for feeding single recording plates or single interleaved sheets from a stack of recording plates and interleaved sheets, to an output position, the apparatus comprising:

a nudger member for nudging a plate or sheet in the stack towards a feed location; and a feed member and cooperating separation member at the feed location for feeding single plates or sheets to the output position;

wherein the contact surfaces of the nudger, feed and separation members are arranged so as to produce sufficient frictional force when in contact with either a plate or a sheet, such that plates or sheets are fed singly towards the output position;

the apparatus further comprising a rotatably mounted cam to move the nudger member from the nudging position to a retracted position.

2. Frictional feed apparatus for feeding single recording plates or single interleaved sheets from a stack of recording plates and interleaved sheets, to an output position, the apparatus comprising:

a nudger member for nudging a plate or sheet in the stack towards a feed location; and a feed member and cooperating separation member at the feed location for feeding single plates or sheets to the output position;

wherein the contact surfaces of the nudger, feed and separation members are arranged so as to produce sufficient frictional force when in contact with either a plate or a sheet, such that plates or sheets are fed singly towards the output position;

further comprising nudger member movement means to move the nudger member from the nudging position to a retracted position; and stack position sensing means to detect when the nudger member is in the nudging position.

3. Frictional feed apparatus for feeding single recording plates or single interleaved sheets form a stack of recording plates and interleaved sheets, to an output position, the apparatus comprising:

a nudger member for nudging a plate or sheet in the stack towards a feed location; and a feed member and cooperating separation member at the feed location for feeding single plates or sheets to the output position;

wherein the contact surfaces of the nudger, feed and separation members are arranged so as to produce sufficient frictional force when in contact with either a plate or a sheet, such that plates or sheets are fed singly towards the output position;

the apparatus further comprising sensing means positioned downstream of the feed location for detecting if a single plate has been successfully fed; and a sheet diverter positioned downstream of the fee location, wherein the sheet diverter is responsive to the sensing means and diverts plates in a first direction and sheets in a second direction.

4. Apparatus according to claim 3, further comprising second sensing means positioned downstream of the sheet diverter in the first direction for detecting if only a single plate has been diverted in the first direction.

5. Apparatus according to claim 4 wherein the second sensing means comprises a first radiation source to illuminate the upper surface of the plate or sheet and a first sensor to monitor the reflected radiation, and a corresponding second radiation source and a second sensor positioned to monitor radiation reflected from the lower surface of the plate or sheet.

6. A method of withdrawing recording plates or interleaved sheets from a stack of recording plates and interleaved sheets, the method comprising nudging a plate or sheet in the stack towards a feed location using a nudger member and feeding the plate or sheet to an output position using a feed member with a cooperating separating member at the feed location wherein the contact surfaces of the nudger, feed and separation members are arranged so as to produce sufficient frictional force when in contact with either a plate or a sheet, such that plates or sheets are fed singly towards an output position.

7. A method according to claim 6, wherein the method further comprises moving the nudger member away from the nudging position to a retracted position when the plate or sheet is in contact with the feed or separating members.

8. A method according to claim 6, further comprising diverting the plates in a first direction and the interleaved sheets in a second direction.

* * * * *